US005688228A

United States Patent [19]

Lin et al.

[11] Patent Number: 5,688,228

[45] Date of Patent: Nov. 18, 1997

[54] AUXILIARY REHABILITATION MACHINE

[76] Inventors: Bin-Zong Lin; Chuan-Hua Lin, both of No. 318 8th Flr., Fushbng, Sec. 3, Taichung, Taiwan

[21] Appl. No.: 511,058

[22] Filed: Aug. 3, 1995

[51] Int. Cl.[6] ..... A61H 7/00

[52] U.S. Cl. ..... 601/92; 601/90; 601/95; 601/103

[58] Field of Search ..... 601/49–54, 85–87, 601/89, 90, 92, 93, 95, 96, 101–103, 115, 116, 114

[56] References Cited

U.S. PATENT DOCUMENTS

| | | | |
|---|---|---|---|
| 2,790,440 | 4/1957 | Adain, Jr. | 601/92 |
| 4,570,617 | 2/1986 | Baus | 601/102 |
| 4,572,166 | 2/1986 | Mabuchi | 601/102 X |
| 4,686,967 | 8/1987 | Hashimoto et al. | 601/116 |
| 4,860,734 | 8/1989 | Lyu | 601/98 |
| 5,033,458 | 7/1991 | Sperr | 601/103 X |

FOREIGN PATENT DOCUMENTS

| | | | |
|---|---|---|---|
| 253700 | 4/1964 | Australia | 601/92 |

*Primary Examiner*—Danton D. DeMille
*Attorney, Agent, or Firm*—Bucknam and Archer

[57] ABSTRACT

An arrangement for a bed intented to be fitted under the bed floor in order to massage the back of the patient laying in the bed. The arrangement comprises several identical movable plates (11) intended to be accommodated under the bed floor. Each plate (11) connects a rotating shaft (111) which is then connects to a power sources. A driving motor (15) is connected to a common computer control system which, during a time-limited work cycle, intermittently control the motor to start or to stop.

1 Claim, 4 Drawing Sheets

AUXILIARY REHABILITATION MACHINE

BACKGROUND OF THE INVENTION

1. Field of the Invention

The present invention relates to an arrangement for a bed intended to be fitted under the bed floor in order to massage the back of a person laying in the bed.

2. Description of the Prior Art

There are many types of massaging beds such as: water bed, air-bag bed which are well known in the art. However, they all have no practical use for the long-term patients, according to the patients-nursing regulations, the patients must be turned around every two hours, thus twelve times a day. With that frequence, the patients will lack normal resting time, the patient-sitters will not have enough continuous resting time either. Furthermore, the patient will get bedsore or other severe infection which will all result in the waste of money, medical resources and valuable man-power. Therefore, potimum caring and massage cannot be expected from these beds.

SUMMARY OF THE INVENTION

Accordingly, it is an object of the present invention to provide a rotating apparatus for adjusting contact surface of the patient's back, which include a main frame (10) comprising several shaft holes (101) on both sides, the movable plate (11) can be insert into each hole (102) by the contact shafts (111) for rotating the movable plate (11).

Another object of the present invention is to provide a pluarity of movable plates (11) set on the bed floor to provide massage to the patient by turning left and right.

A further object of the present invention is to provide a gear wheel (112), which connects the motor by way of a gear chain (12), which turns the movable plate (11) left and right.

Still another object of the present invention is to provide a regulation set (13), which has a long thorough hole on the driving-control set (14) to form a integrate part.

Another object of the present invention is a driving-control set (14) which comprises of a driving-control switch (140). The contact rod (12) set on the side of the gear wheel (112) will stop the motor when touching the driving-control switch (140).

Other objects and further scope of the applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description drawings which are given by way of illustration only, and thus are not limitative of the present invention, and wherein.

DETAILED DESCRIPTION OF THE INVENTION

Figure 1:
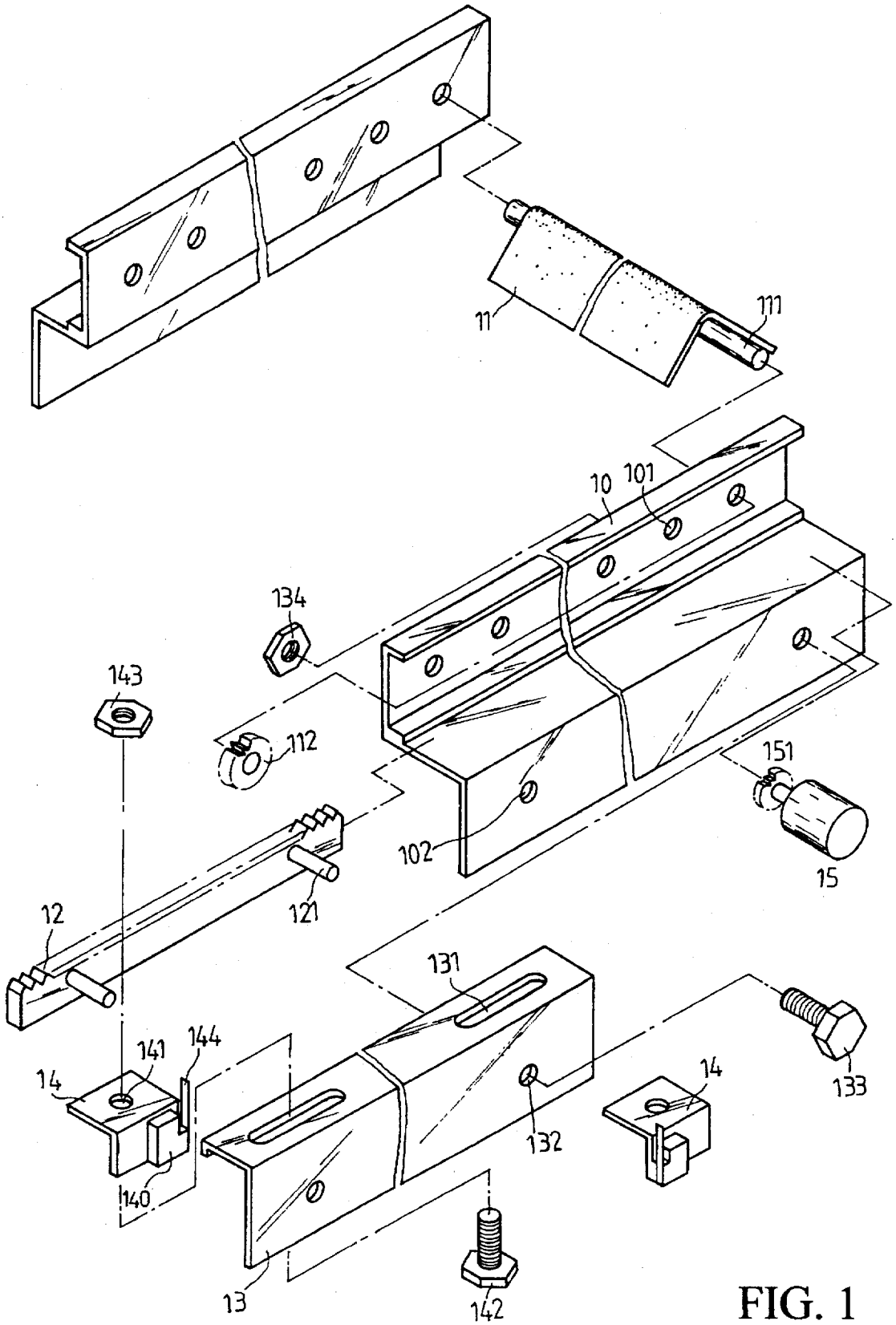
FIG. 1 is a perspective view of a massage apparatus in accordance with the present invention.

Referring now in detail to the drawings for the purpose of illustrating preferred embodiments of the present invention, the massage apparatus as shown in FIG. 1 comprises a main frame (10), several movable plates (11), a gear chain (12), a regulating set (13), a driving-control set (14) and a motor (15).

Figure 2:
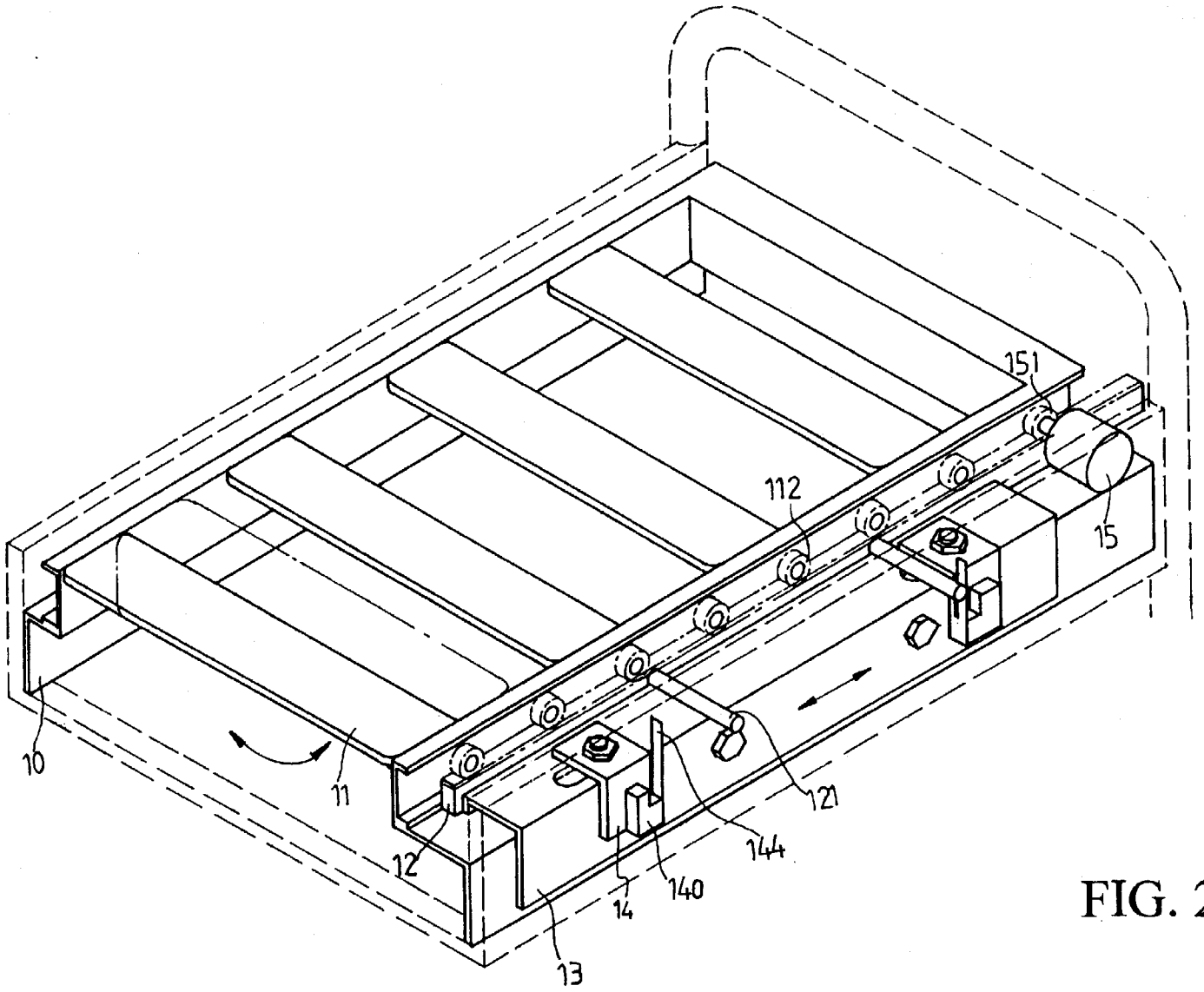
FIG. 2 is an perspective view of a massage apparatus of the present invention showing in cut away portions.
Figure 3:
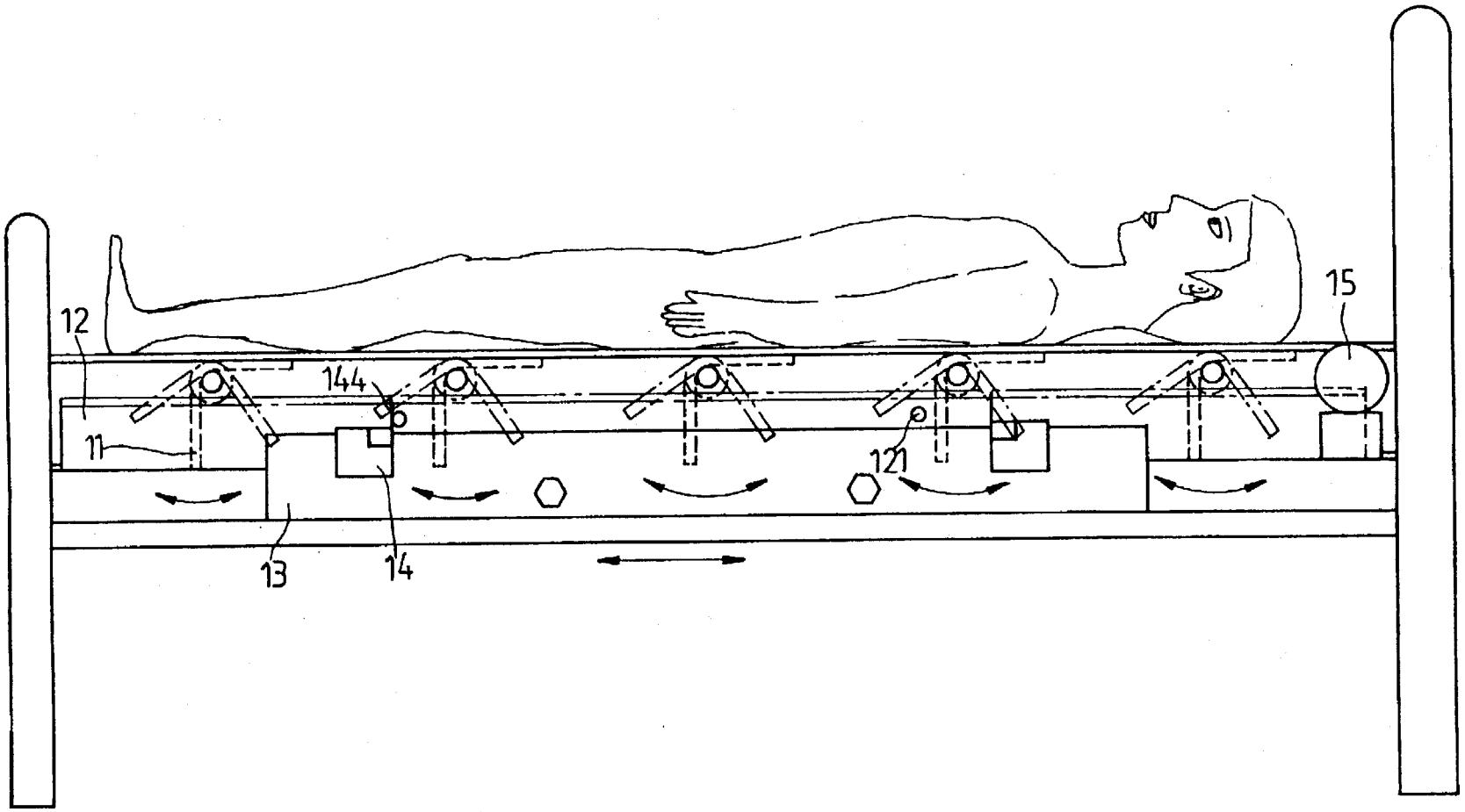
FIG. 3 is perspective view of the present invention showing in application condition.
Figure 4:
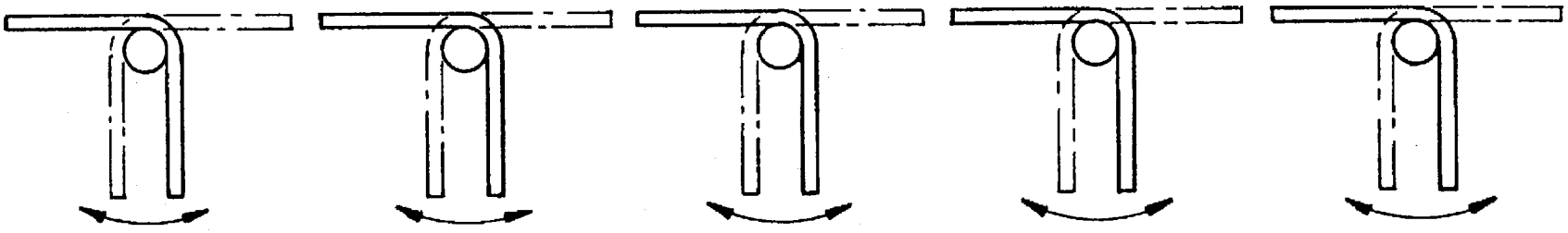
FIG. 4 is perspective view of the present invention showing in operation condition.

As shown in FIGS. 2, 3, and 4, the motor (15) is started by the driving-control switch (140) the gear wheel (151) then starts the gear chain (12) to move left and right which then start the pluarity of gear (112) to turn and the movable plate (11) to change direction. When the rod (121) touches the spring (144) of the drying-control switch (140), it then stops. The movable plate (11), upon the time limit ending, will turn horizontally by the motor (15) controlled by the driving-control switch (140). The upward angle of the movable plate (11) increase in accordance with the time length of the contact rod (121) touching the spring (144). In other words, the longer the contact rod (121) touches the spring (144) the larger the upward angle of the movable plate (11) will be and vice versa. The movable plate (11) forms a smooth angle when the shaft rod (111) turns to its turning point. It is this smooth angle that provides a massage function to the patient's back. Therefore, the more the turning time runs the better the massage effect is.

This is the most particular aspect of the present invention.

Furthermore, the contact surface will change with the turning of the movable plate (11). The design of the turning frequence and the time space in between will provide air contact to the patient's back, thus keeps it dry and eliminates the skin disease caused by light contact between the skin and the bed. The shorter the time space between two stops, the more the movable plate (11) turns.

Again, please, referring to FIGS. 2, 3 and 4, when the driving-control switch (140) starts the motor after setting the time limit, the gear chain (12) will be driven to move left and right by the gear wheel (112), which will then the the gear (112) to turn and change the direction of the movable plate (11). The moving gear chain (12) will then touch the spring (144) of the driving-control switch (140) with the contact rod (121) set on the side. The motor (15) will stop and in turn stop the gear chain (12) which in turn keeps the bed in a horizontal position. The driving-control switch (140) will restart the motor (12) to move counter-clockwise.

When the time limit ends. The above-mentioned parts will move backwards. Thus change the direction of the movable plate (11). The contact surface of the body will change which then shorten the time length of the bed contacting with the same part of the back. The contact surface will change and the contact time length will shorten, thus provide more air penetration of the patient's back and prevent the possibility of acquiring skin diseases.

When the movable plate (11) are on the move, the smooth angle of the rotating shaft (111) will massage the patient's back, thus provide better blood circulation.

The turning angle of the movable plate (11) is determined by the space between two driving-control sets (14). The longer the space is, the longer the gear chain (12) moves. The longer the gear chain (12) moves, the bigger the turning angle is.

The invention being thus described, it will be obvious that the same way be varied in many ways. Such variations are not to be regarded as a departure from the spirit and scope of the invention, and all such modifications as would be obvious to one skilled in the art are intended to be included in the scope of the following claims:

What is claimed is:

1. A massaging bed for adjusting different pressure points, increasing blood circulation, thus eliminating the possibility of bedsores and other infection comprising:

a main frame with the same width as a bed, said main frame including a plurality of movable plates (11) disposed with equal space in between, each movable plate (11) connected to said main frame (10) at both ends thereof, a shaft rod (111) disposed under the movable plate (11), said shaft rod (111) being connected to both sides of the main frame (10), a plurality of gear wheels (112) disposed on the outside of the shaft rod (111), under each gear wheel (112), a gear chain (12) is disposedly engaged, as the gear chain (12) moves horizontally the gear wheel (112) rotates to cause the movable plate (11) to turn and oscillate, a regulating set (13) is disposed under the gear chain (12), the regulating set (13) is fixedly disposed on the main frame (10) to form an integral part, a driving-control set (14) disposed on the regulating set (13), said driving-control set (14) including a driving-control switch (14), a spring (144) disposed on the driving-control switch (140), the gear chain (12) having two contact rods (121) disposed on opposite ends thereof, the distance between the contact rod (121) and the spring (144) changes with the regulating set (14) moving left and right, therefore, the moving distance of the gear wheel (12) changes, the turning angle of the movable plate (11) is determined by the driving-control set (14) moving along the regulating set (13).

* * * * *